US006139395A

United States Patent [19]

Liao

[11] Patent Number: 6,139,395

[45] Date of Patent: Oct. 31, 2000

[54] SOFT TOY STRUCTURE CONTAINING THEREIN A FLUID MATERIAL AND A METHOD FOR MANUFACTURING THE SOFT TOY

[76] Inventor: Chu-Yuan Liao, 5F-1, No. 177, Sec. 1 Ho-Ping E. Rd., Taipei, Taiwan

[21] Appl. No.: 09/452,454

[22] Filed: Dec. 2, 1999

[51] Int. Cl.[7] ..... A63H 3/52

[52] U.S. Cl. ..... 446/267; 496/74

[58] Field of Search ..... 446/74, 183, 267, 446/71, 72, 76

[56] References Cited

U.S. PATENT DOCUMENTS

| | | | |
|---|---|---|---|
| 2,705,090 | 3/1955 | Odermatt-Wehrli | 446/183 |
| 2,931,136 | 4/1960 | Loewy | 446/267 |
| 3,245,174 | 4/1966 | Gardel et al. | 446/267 |
| 3,601,923 | 8/1971 | Rosenberg | 446/267 |
| 4,657,021 | 4/1987 | Perry et al. | 446/267 |
| 4,761,314 | 8/1988 | Marshall | 446/267 |
| 4,846,116 | 7/1989 | Diresta et al. | 446/267 |
| 4,952,190 | 8/1990 | Tarnoff et al. | 446/267 |
| 5,240,450 | 8/1993 | Graham | 446/267 |
| 5,975,983 | 11/1999 | Panec | 446/267 |

*Primary Examiner*—Sam Rimell
*Attorney, Agent, or Firm*—Dougherty & Troxell

[57] ABSTRACT

A soft toy structure containing therein a fluid material and a method for manufacturing the soft toy. The soft toy includes a soft envelope body. An outer periphery of the envelope body is integrally formed with convex section with a predetermined pattern. The envelope body with the convex section is turned inside out to reverse the convex section into a concave face. The outer opening of the concave face is adhered with and sealed by a film and then the envelope body is turned back. At this time, the interior of the envelope body is isolated from the interior of the convex section as two close spaces. Then the fluid material is respectively filled into the two close spaces to form a soft toy containing therein a fluid material and having a convex section with predetermined pattern. The convex section is integrally formed on the outer surface of the envelope body without leaving any adhesive track on the surface of the soft toy. In addition, the interior spaces of the envelope body and the convex section are isolated from each other so that different properties, colors and amounts of fluid materials can be respectively filled into the two interior spaces to effectively control the variation of pattern of the soft toy.

10 Claims, 2 Drawing Sheets

SOFT TOY STRUCTURE CONTAINING THEREIN A FLUID MATERIAL AND A METHOD FOR MANUFACTURING THE SOFT TOY

BACKGROUND OF THE INVENTION

The present invention relates to a soft toy structure Containing therein a fluid material and a method for manufacturing the soft toy. The soft envelope body of the soft toy structure is integrally formed with a convex section with a predetermined pattern. Then the envelope body with the convex section is turned inside out to reverse the convex section into a concave face. The outer opening of the concave face is adhered with and sealed by a film to isolate the interior of the envelope body from the interior of the convex section as two close spaces. Then identical or different fluid materials are respectively filled into the two close spaces to form a soft toy containing therein a fluid material and having a convex section with predetermined pattern.

A conventional soft toy containing therein a fluid is generally made of an integrally molded envelope body in which a fluid is directly filled. Such soft toy always has monotonous pattern and can be hardly designed with versatile configurations as a container made of hard casing. In order to enhance the attraction of the soft toy, it is necessary to increase the variation of the pattern of the soft toy. To achieve this object, a convex decorative section is adhered to the outer surface of the soft toy and a fluid material is filled into the convex section to form various kinds of patterns of soft toys containing therein a fluid. However, such manufacturing and processing procedure is quite troublesome and inconvenient. Moreover, after manufacturing, an adhesive track will be left on the surface of the toy. This deteriorates the entire visual feeling of the toy.

In the case that the convex section is directly integrally formed on the soft envelope body, the convex section lacks internal supporting force so that it often takes place that after the fluid is filled into the envelope body, the weight of the fluid presses the convex section down and makes the convex section suspended or makes the outer edge of the convex section over-expanded and deformed. Therefore, the original pattern will be destroyed and can be hardly controlled.

SUMMARY OF THE INVENTION

It is therefore a primary object of the present invention to provide a soft toy structure containing therein a fluid material and a method for manufacturing the soft toy. The outer periphery of a soft envelope body is integrally formed with a convex section with a predetermined pattern. The envelope body is previously formed with a reservation hole. Through the reservation hole, the envelope body with the convex section is turned inside out to reverse the convex section into a concave face. Then, the outer opening of the concave face is adhered with and sealed by a film. Thereafter, the envelope body is turned back. At this time, the interior of the envelope body is isolated from the interior of the convex section as two close spaces. Then identical or different fluid materials are respectively filled into the two close spaces to form a soft toy containing therein a fluid material and having a convex section with predetermined pattern. The convex section is integrally formed on the outer surface of the envelope body and adhered with and sealed by a film on inner face. Therefore, the film serves as an in-built isolating structure and no adhesive track will be left on the surface of the soft toy. Accordingly, the appearance of the entire of soft toy can be kept perfect to achieve a novel visual effect.

It is a further object of the present invention to provide the above soft toy structure and the manufacturing method in which the interior spaces of the envelope body and the convex section are isolated from each other by internal film so that different colors or properties of fluid materials can be respectively filled into the two interior spaces to obtain various patterns of soft toys. In addition, the convex section is fully supported so that the problem of over-expansion or suspension of the convex section is avoided.

The present invention can be best understood through the following description and accompanying drawings wherein:

DETAILED DESCRIPTION OF THE PREFERRED EMBODIMENT

Figure 2:
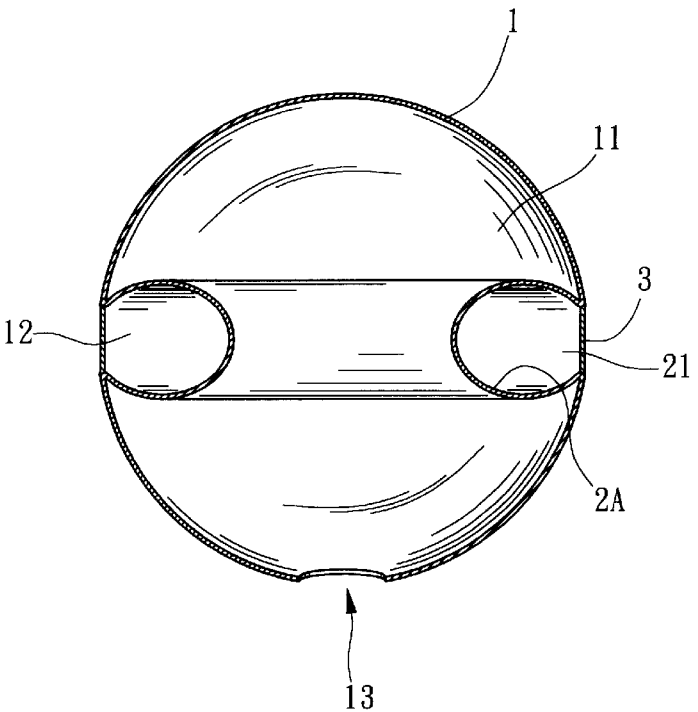
FIG. 2 is a sectional view of the blank envelope body of the present invention, which is turned inside out and adhered with and sealed by the film.
Figure 1:
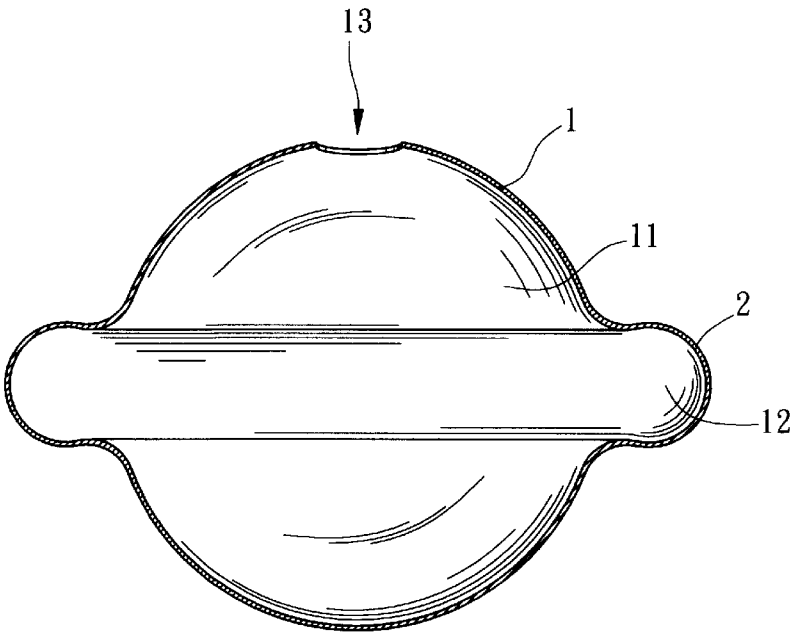
FIG. 1 is a sectional view of the blank envelope body of the present invention, which is not yet sealed by the film.
Figure 4:
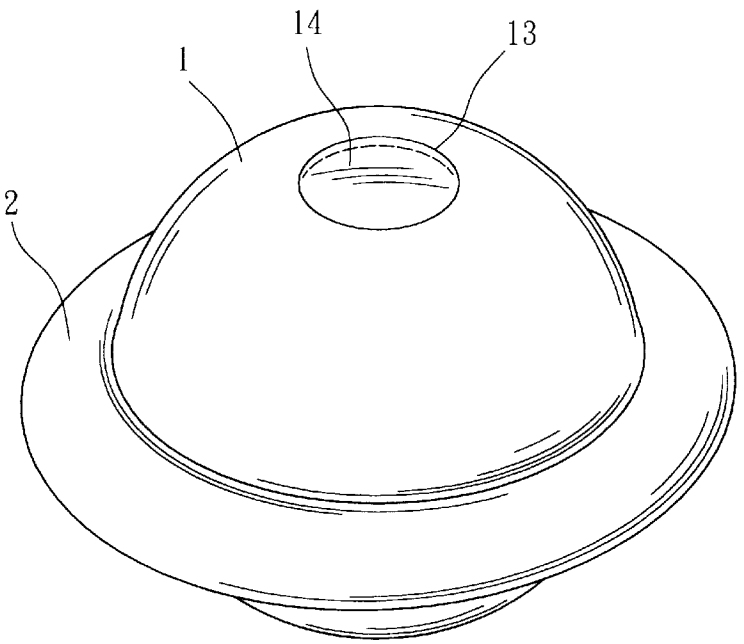
FIG. 4 is a perspective view of a completed soft toy of the present invention.
Figure 3:
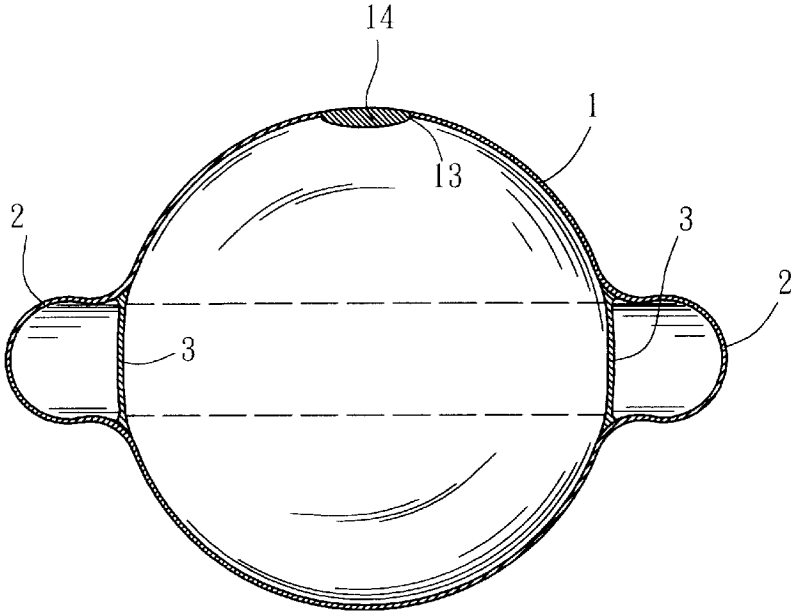
FIG. 3 is a sectional view according to FIG. 2, showing that the blank envelope body of the present invention is turned back into its original convex state and the reservation hole is sealed.

Please refer to FIGS. 1 to 4. The present invention includes a soft transparent or semitransparent envelope body 1. The outer periphery of the envelope body 1 is integrally formed with convex section 2 with a predetermined pattern. The envelope body 1 is previously formed with a reservation hole 13. Through the reservation hole 13, the envelope body 1 with the convex section 2 is turned inside out to make the inner face exposed outside. Under such circumstance, the convex section 2 is reversed into a concave face 2A as shown in FIG. 2. At this time, the outer opening of the concave face 2A is sealed by a film 3. Thereafter, through the reservation hole 13, the envelope body 1 is turned back to its original convex pattern. At this time, the interior of the envelope body 1 is isolated from the interior of the convex section 2 as two sections 11, 21. Then the reservation hole 13 is sealed by a suitable sealing material 14. The fluid material can be filled into the interior sections 11, 21 of the envelope body 1 and the convex section 2 prior to or after sealing of the reservation hole 13. Thereafter, a soft toy containing therein a fluid material is completed. The convex section 2 is adhered to the soft envelope body 1 on inner wall so that no adhesive track will be left on the outer surface of the entire soft toy and the appearance of the soft toy can be kept perfect.

It should be noted that in the case that the fluid material is filled into the soft toy after being sealed, an implement such as a needle can be thrust into the interior sections of the envelope body 1 and the convex section 2 to first suck off the internal air and vacuum within the soft toy. Then the fluid material is filled into the soft toy. Finally, the needle orifices remaining on the plastic envelope body 1 is filled and sealed. The convex section 2 is integrally formed on the outer surface of the envelope body 1 with various decorative solid patterns without leaving any adhesive track on the surface of the soft toy.

The envelope body 1 of the present invention is made of transparent or semitransparent plastic material and different colors of fluid materials can be filled into the envelope body 1 and the convex section 2 so as to achieve a novel visual effect.

The above embodiment is only used to illustrate the present invention, not intended to limit the scope thereof. Many modifications of the above embodiment can be made without departing from the spirit of the present invention.

What is claimed is:

1. A soft toy structure containing therein a fluid material, comprising a soft envelope body, an outer periphery of the envelope body being integrally formed with convex section with a predetermined pattern, an edge of an inner concave face of the convex section being adhered with and sealed by a film, whereby the interior of the envelope body is isolated from the interior of the convex section and whereby the interior of the convex section extends around the interior of the envelope body, the fluid material being respectively filled into the two interior sections.

2. A soft toy structure containing therein a fluid material as claimed in claim 1, wherein the soft envelope body is made of soft plastic material.

3. A soft toy structure containing therein a fluid material as claimed in claim 1, wherein two different colors of fluid materials are respectively filled into the two interior sections of the envelope body and the convex section.

4. A soft toy structure containing therein a fluid material as claimed in claim 2, wherein two different colors of fluid materials are respectively filled into the two interior sections of the envelope body and the convex section.

5. A method for manufacturing a soft toy structure containing therein a fluid material, comprising the steps of:

integrally forming a convex section on an outer periphery of a soft envelope body with a predetermined pattern;

previously forming a reservation hole on the envelope body;

through the reservation hole, turning the envelope body with the convex section inside out to make the inner face exposed outside, whereby the convex section is reversed into a concave face;

sealing the outer opening of the concave face with a film and then through the reservation hole turning the envelope body back to its original convex pattern, whereby the interior of the envelope body is isolated from the interior of the convex section as two close spaces; and sealing the reservation hole and respectively filling the fluid material into the two close spaces.

6. A method for manufacturing a soft toy structure containing therein a fluid material as claimed in claim 5, wherein different fluid materials are respectively filled into the two close spaces of the envelope body and the convex section.

7. A method for manufacturing a soft toy structure containing therein a fluid material as claimed in claim 5, wherein identical fluid materials are filled into the two close spaces of the envelope body and the convex section.

8. A method for manufacturing a soft toy structure containing therein a fluid material as claimed in claim 5, wherein different colors of fluid materials are respectively filled into the two close spaces of the envelope body and the convex section.

9. A method for manufacturing a soft toy structure containing therein a fluid material as claimed in claim 6, wherein different colors of fluid materials are respectively filled into the two close spaces of the envelope body and the convex section.

10. A method for manufacturing a soft toy structure containing therein a fluid material as claimed in claim 7, wherein different colors of fluid materials are respectively filled into the two close spaces of the envelope body and the convex section.

* * * * *